US006778797B2

(12) United States Patent
Sato et al.

(10) Patent No.: US 6,778,797 B2
(45) Date of Patent: Aug. 17, 2004

(54) CHARGING ROLLER HAVING ELASTIC MEMBER

(75) Inventors: Masumi Sato, Kanagawa (JP); Yukiko Iwasaki, Kanagawa (JP); Hitoshi Ishibashi, Tokyo (JP); Hiroshi Yoshinaga, Chiba (JP); Takatsugu Fujishiro, Tokyo (JP); Masami Hiramatsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/758,192

(22) Filed: Jan. 12, 2001

(65) Prior Publication Data

US 2001/0012460 A1 Aug. 9, 2001

(30) Foreign Application Priority Data

Jan. 13, 2000 (JP) ..... 2000-004769

(51) Int. Cl.[7] ..... G03G 15/02
(52) U.S. Cl. ..... 399/176
(58) Field of Search ..... 399/176, 168, 399/174; 361/225

(56) References Cited

U.S. PATENT DOCUMENTS

| | | | | |
|---|---|---|---|---|
| 5,146,280 A | * | 9/1992 | Kisu | 399/176 |
| 5,339,141 A | | 8/1994 | Suzuki et al. | |
| 5,424,814 A | | 6/1995 | Suzuki et al. | |
| 5,438,401 A | | 8/1995 | Murayama et al. | |
| 5,440,373 A | | 8/1995 | Deki et al. | |
| 5,512,984 A | | 4/1996 | Kimura et al. | |
| 5,515,145 A | | 5/1996 | Sasaki et al. | |
| 5,537,197 A | | 7/1996 | Fujishiro et al. | |
| 5,565,973 A | | 10/1996 | Fujishiro et al. | |
| 5,583,630 A | | 12/1996 | Kimura et al. | |
| 5,623,330 A | | 4/1997 | Ishibashi | |
| 5,655,193 A | | 8/1997 | Fujishiro et al. | |
| 5,659,843 A | | 8/1997 | Takano et al. | |
| 5,671,465 A | | 9/1997 | Kimura et al. | |
| 5,799,229 A | | 8/1998 | Yokoyama et al. | |
| 5,946,529 A | | 8/1999 | Sato et al. | |
| 5,953,568 A | | 9/1999 | Fujishiro et al. | |
| 6,006,050 A | | 12/1999 | Watanabe et al. | |
| 6,014,532 A | | 1/2000 | Takeichi et al. | |

(List continued on next page.)

FOREIGN PATENT DOCUMENTS

| | | | |
|---|---|---|---|
| JP | 4-360168 A | * | 12/1992 |
| JP | 5-43156 | | 6/1993 |
| JP | 6-242695 | * | 9/1994 |
| JP | 8-123151 | * | 5/1996 |
| JP | 9-439434 | * | 2/1997 |
| JP | 9-179444 | | 7/1997 |
| JP | 9-258524 | | 10/1997 |
| JP | 2740998 | | 1/1998 |

*Primary Examiner*—Quana Grainger
(74) *Attorney, Agent, or Firm*—Oblon, Spivak, McClelland, Maier & Neustadt, P.C.

(57) ABSTRACT

A charging device, an image forming apparatus including the charging device, an image carrier unit including the charging device and a charging roller, which faces a body to be charged and is applied with a voltage, are disclosed. The charging roller includes a metallic core and an elastic member covering the core. Films are respectively wrapped around and adhered to the opposite end portions of the elastic member. Springs press the charging roller toward a body to be charged, causing the elastic member to deform due to compression. The maximum deformation of the films, which deform along the outer periphery of the elastic member, is selected to be smaller than the thickness of each film in the radial direction of the charge roller. A gap is therefore formed between the elastic member and the body to be charged. This prevents the portion of the elastic member, which corresponds to an image forming region, other than opposite end portions from contacting the surface of the body to be charged.

52 Claims, 13 Drawing Sheets

U.S. PATENT DOCUMENTS 6,055,388 A 4/2000 Watanabe et al.
6,055,394 A 4/2000 Suda et al.
6,070,030 A 5/2000 Fujishiro
6,088,551 A 7/2000 Satoh et al.
6,101,351 A 8/2000 Suda et al.
6,118,964 A 9/2000 Kojima et al.
6,208,826 B1 3/2001 Yoshinaga et al.
6,219,520 B1 4/2001 Ehara
6,249,304 B1 6/2001 Sawayama et al.
6,256,465 B1 7/2001 Yoshinaga et al.
6,292,206 B1 9/2001 Takehara et al.
6,295,438 B1 9/2001 Fujishiro et al.
6,334,039 B1 12/2001 Yoshinaga et al.
6,336,013 B1 1/2002 Suda et al.
6,366,754 B1 4/2002 Sato et al.

* cited by examiner

*Fig. 9*

| CHARGE ROLLER | CORE | RUBBER THICKNESS | ROLLER HARDNESS | FILM | FILM THICKNESS | FILM WIDTH |
|---|---|---|---|---|---|---|
| SAMPLE # 1 | $\phi$ 9 | 1.5 mm | 75 | PF025-H | 60 $\mu$m | 8 mm |
| SAMPLE # 2 | $\phi$ 8 | 2 mm | 65 | PF050-H | 85 $\mu$m | 8 mm |
| SAMPLE # 3 | $\phi$ 8 | 3 mm | 60 | ABSENT ; CONTACT | – | – |
| SAMPLE # 4 | $\phi$ 8 | 3 mm | 60 | PF075-H | 105 $\mu$m | 8 mm |
| SAMPLE # 5 | $\phi$ 8 | 3 mm | 60 | PF075-H | 100 $\mu$m | 8 mm |

*Fig. 10*

| CHARGE ROLLER | DEFORMATION | NIP WIDTH | INITIAL CHARGING ABILITY | LONG-TERM CHARGING ABILITY | INITIAL CHARGING NOISE |
|---|---|---|---|---|---|
| SAMPLE # 1 | 20 μm | 1 mm | ○ | ○ | ○ |
| SAMPLE # 2 | 40 μm | 1.4 mm | ○ | ○ | ○ |
| SAMPLE # 3 | – | – | ○ | × | × |
| SAMPLE # 4 | 60 μm | 1.7 mm | × | ○ | ○ |
| SAMPLE # 5 | 60 μm | 1.7 mm | ○ | ○ | ○ |

CHARGING ROLLER HAVING ELASTIC MEMBER

BACKGROUND OF THE INVENTION

The present invention relates to a charging device including a charge roller made up of a metallic core, an elastic member covering the core and films wrapped around the opposite end portions of the elastic member and contacting a body to be charged, an image forming apparatus including the charging device, an image carrier unit including the charging device, and a charging roller facing the surface of a body to be charged and applied with a voltage.

It is a common practice with a copier, printer, facsimile apparatus or similar electrophotographic image forming apparatus to uniformly charge the surface of a photoconductive element or image carrier, which is a body to be charged, before forming a latent image thereon. Corona discharge is one of conventional methods for charging the photoconductive element. A corona discharger includes a housing shielded by a metallic plate and a charge wire formed of, e.g., tungsten or nickel. The charge wire is positioned at the center of the housing in close proximity to the photoconductive element. A DC voltage or an AC-biased DC voltage is applied between the charge wire and the photoconductive element, so that the resulting corona discharge charges the surface of the photoconductive element.

The corona discharger, however, has a problem that the high voltage applied to the charge wire produces ozone, nitrogen oxides (NOx) and so forth, which are undesirable from the environment standpoint. Further, such products ascribable to discharge form a film of nitric acid or nitrate on the surface of the photoconductive element, adversely effecting image formation.

Today, a contact type charging device that produces a minimum of ozone and needs a minimum of power is replacing a corona discharger. A contact type charging device includes a conductive charging member implemented as a roller, a brush or an elastic blade. A voltage is applied between the charging member and the photoconductive element, which contact each other, in order to charge the surface of the photoconductive element.

The charging member implemented as a roller, for example, is made up of a metallic core and an elastic layer covering the core and formed of conductive rubber. This brings about a problem that when the contact type charging device is left unused over a long period of time with the roller being pressed against the photoconductive element, a plasticizer and other substances contained in the elastic layer ooze out and deposit on and contaminate the surface of the photoconductive element. Another problem with the contact type charging device is that when the charging member charges the photoconductive element in contact therewith, toner left on the photoconductive element after image transfer is likely to deposit on the charging member and lower the ability of the charging member.

In light of the above, Japanese Patent Laid-Open Publication Nos. 3-240076, 4-360167 and 5-107871, for example, disclose non-contact type charging devices. The non-contact type discharging devices each include a charging member implemented as a charge roller. Spacers or tapes, for example, are wrapped around the opposite end portions of the charge roller, forming annular projections larger in diameter than the intermediate portion of the roller. The projections space the portion of the charge roller other than the opposite end portions from a photoconductive element or image carrier. As a result, the portion of the charge roller corresponding to an image forming region does not contact the photoconductive element. This successfully solves the previously discussed problems particular to the contact type charging device.

Even the non-contact type charging device described above has the following problems left unsolved. In the charging device taught in, e.g., Laid-Open Publication No. 3-240076, the charge roller includes a surface layer formed of EPDM (ethylene-propylene terpolymer) or similar conductive rubber and spacer ring layers formed on the opposite end portions of the surface layer. Springs or similar biasing means press the portions of the charge roller outside of the spacer ring layers. In this condition, the portion of the charge roller other than the spacer ring layers is spaced from the surface of a photoconductive element.

In the above non-contact type charging device, only a DC voltage is usually applied to the charge roller. So long as a gap between the charge roller and the photoconductive element is smaller than preselected a preselected value (e.g. 20 $\mu$m), a preselected charge potential is insured even if the above gap varies. However, once the gap exceeds the preselected value, the charge potential falls, i.e., decreases in absolute value in accordance with the gap. To compensate for the fall of the charge potential, an AC-biased DC voltage has customarily been applied to the charge roller. In this case, it is necessary to limit the voltage to a level that does not cause abnormal discharge to occur. The above gap should therefore be limited to a value that does not bring about abnormal discharge, limiting the thickness of the spacer rings.

Generally, an electrophotographic image forming apparatus includes an image transfer roller, a discharge roller, a developing roller and other charging rollers in addition to the charge roller. All of such charging rollers face an image carrier to be charged. When any one of the charging rollers constantly remains in contact with the image carrier in its portion other than opposite end portions, it is likely that residual toner and impurities are transferred from the image carrier to the roller and obstruct the expected function of the roller.

Technologies relating to the present invention are also disclosed in, e.g., Japanese Utility Model Laid-Open Publication No. 5-43156, Japanese Patent Laid-Open Publication Nos. 9-179444 and 9-258524, and Japanese Patent No. 2,740,998.

SUMMARY OF THE INVENTION

It is therefore an object of the present invention to prevent the intermediate portion of a charge roller from constantly contacting the surface of an image carrier even if films, or spacers, positioned on the opposite end portions of the roller are thin enough to obviate abnormal discharge around the films.

It is another object of the present invention is to prevent even a charging roller, which faces the surface of a body to be charged and is applied with a voltage, other than a charge roller from constantly contacting the above body in the intermediate portion thereof.

In accordance with the present invention, a charging device for charging the surface of a body to be charged includes a charge roller having a metallic core and an elastic member covering the surface of the core. Films are respectively wrapped around the opposite end portions of the charge roller such that the roller contacts the body to be charged via the films. A voltage is applied between the charge roller and the body to be charged. When the elastic member deforms due to compression ascribable to the contact of the charge roller with the body to be charged, the films deform along the outer periphery of the elastic member by a maximum amount, as measured in the radial direction of the charge roller, which is smaller than the thickness of the films.

Also, in accordance with the present invention, in an image forming apparatus including a charge roller, which has a metallic core and an elastic member covering the core, for charging the surface of a drum-like image carrier in response to a voltage applied between the charge roller and the image carrier to thereby allow a latent image to be optically formed on the above surface, films are respectively wrapped around the portions of the image carrier corresponding to the opposite end portions of the charge roller such that the opposite end portions of the charge roller respectively contact the films. The portions of the elastic member deformed due to compression ascribable to contact of the charge roller with the image carrier have a maximum deformation, as measured in the radial direction of the charge roller, which is smaller than the thickness of the films.

BRIEF DESCRIPTION OF THE DRAWINGS

The above and other objects, features and advantages of the present invention will become more apparent from the following detailed description taken with the accompanying drawings in which:

FIGS. 9 and 10 are tables listing specific experimental samples and the results of experiments conducted therewith;

DESCRIPTION OF THE PREFERRED EMBODIMENTS

Figure 1:
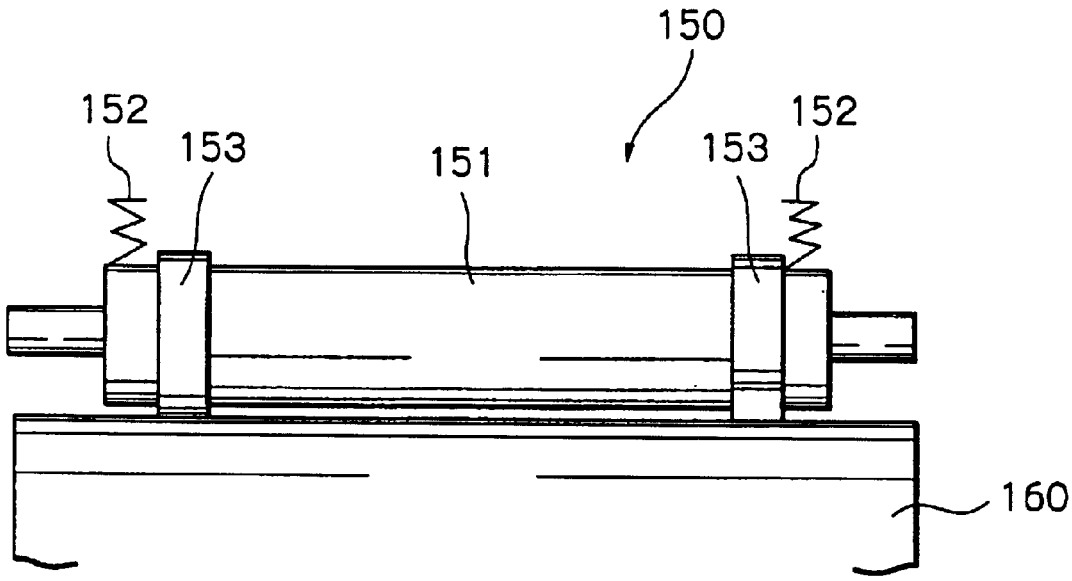
Fig. 1 PRIOR ART
FIG. 1 is a front view showing a conventional charging device in which a charge roller does not contact an image carrier in its portion other than opposite end portions.

To better understand the present invention, brief reference will be made to a conventional charging device, shown in FIG. 1. The charging device to be described is taught in previously mentioned Japanese Patent Laid-Open Publication No. 3-240076 by way of example. As shown, the charging device includes a charge roller 150 having an elastic surface layer 151, which is formed of EPDM or similar conductive rubber. Spacer ring layers 153 are formed on opposite end portions of the surface layer 151. Springs or similar biasing means 152 press the portions of the charge roller 150 outside of the spacer ring layers 153. In this condition, the spacer ring layers 153 contact the surface of a photoconductive element or image carrier 160, but the portion of the charge roller 151 between the spacer ring layers 153 is spaced from the above surface.

Figure 2:
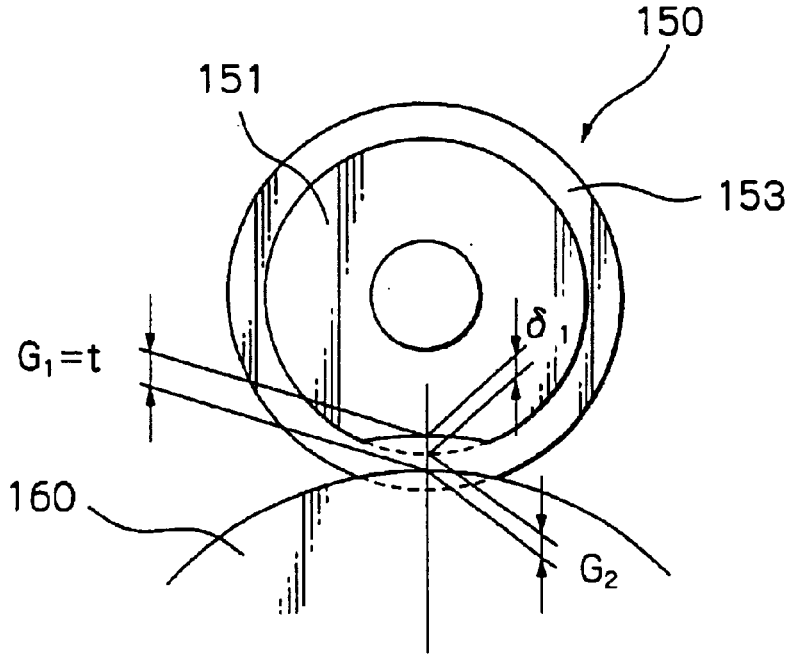
Fig. 2 PRIOR ART
FIG. 2 is a side elevation showing how a gap between the charge roller of the device shown in FIG. 1 and the image carrier decreases in the intermediate portion.

In the configuration shown in FIG. 1, the surface layer 151, particularly its portions where the spacer ring layers 153 are present, deform due to the forces of the springs 152. Consequently, as shown in FIG. 2, a gap $G_1$ between the charge roller 150 and the photoconductive element 160, as measured in the vicinity of the spacer ring layers 153, is equal to the thickness t of the spacer ring layers 153. However, a gap $G_2$ between the intermediate portion of the charge roller 150 and the photoconductive element 160 is smaller than the gap $G_1$ by the amount of deformation $\delta_1$ of the surface layer 151 ($G_2=G_1-1$). This is true even when the bend, linearity and so forth of the charge roller 150 are neglected.

The above relation between the gaps $G_1$ and $G_2$ brings about the following problem. Assume that the thickness t of the spacer ring layers 153 is relatively small. Then, despite that the charging device is configured to be of the concontact type, the intermediate portion of the surface layer 151 of the charge roller 150 is apt to constantly remain in contact with the surface of the photoconductive element 160. Such a charging device cannot solve the problems of the contact type charging device.

The thickness t of the spacer ring layers 153 may be selected to be great enough to prevent the intermediate portion of the surface layer 151 from contacting the surface of the photoconductive element 160 despite the deformation $\delta_1$ of the surface layer 151. This, however, increases the gap G1 of the surface layer 151 in the vicinity of the spacer ring layers 153 and thereby causes abnormal discharge to occur, resulting in white spots in an image. The thickness t therefore should not be increased beyond a certain limit.

More specifically, in the non-contact type charging device, an AC-biased DC voltage is applied to the charge roller 150 so as to allow the roller 150 to uniformly charge the surface of the photoconductive element 160, as stated earlier. The abnormal discharge occurs when the above voltage is excessively high for a given gap between the charge roller and the photoconductive element. It is therefore necessary to limit the voltage to a level that does not bring about the abnormal discharge. This is why the thickness t of the spacer ring layers 153 is limited.

Figure 3:
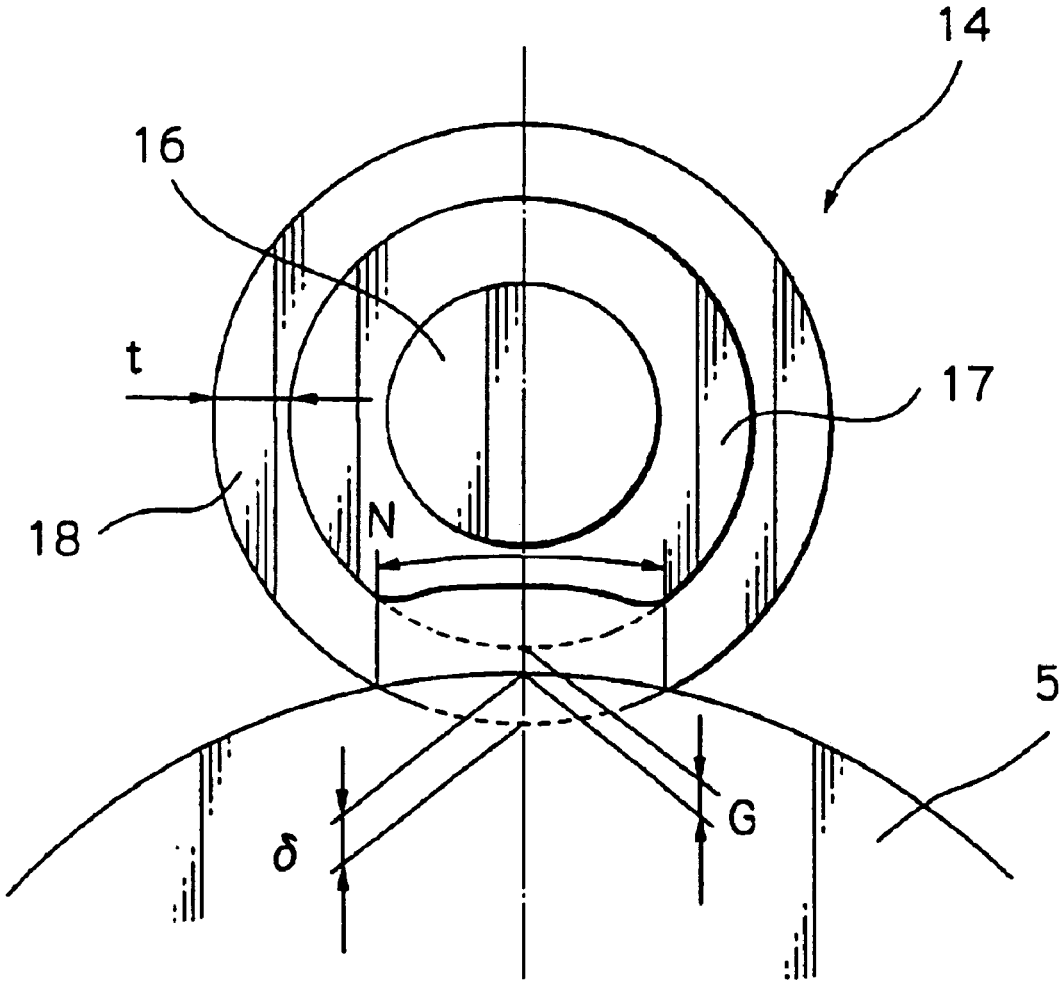
FIG. 3 is a side elevation showing a charge roller, which is included in a charging device embodying the present invention, pressed against a photoconductive drum or image carrier.
Figure 4:
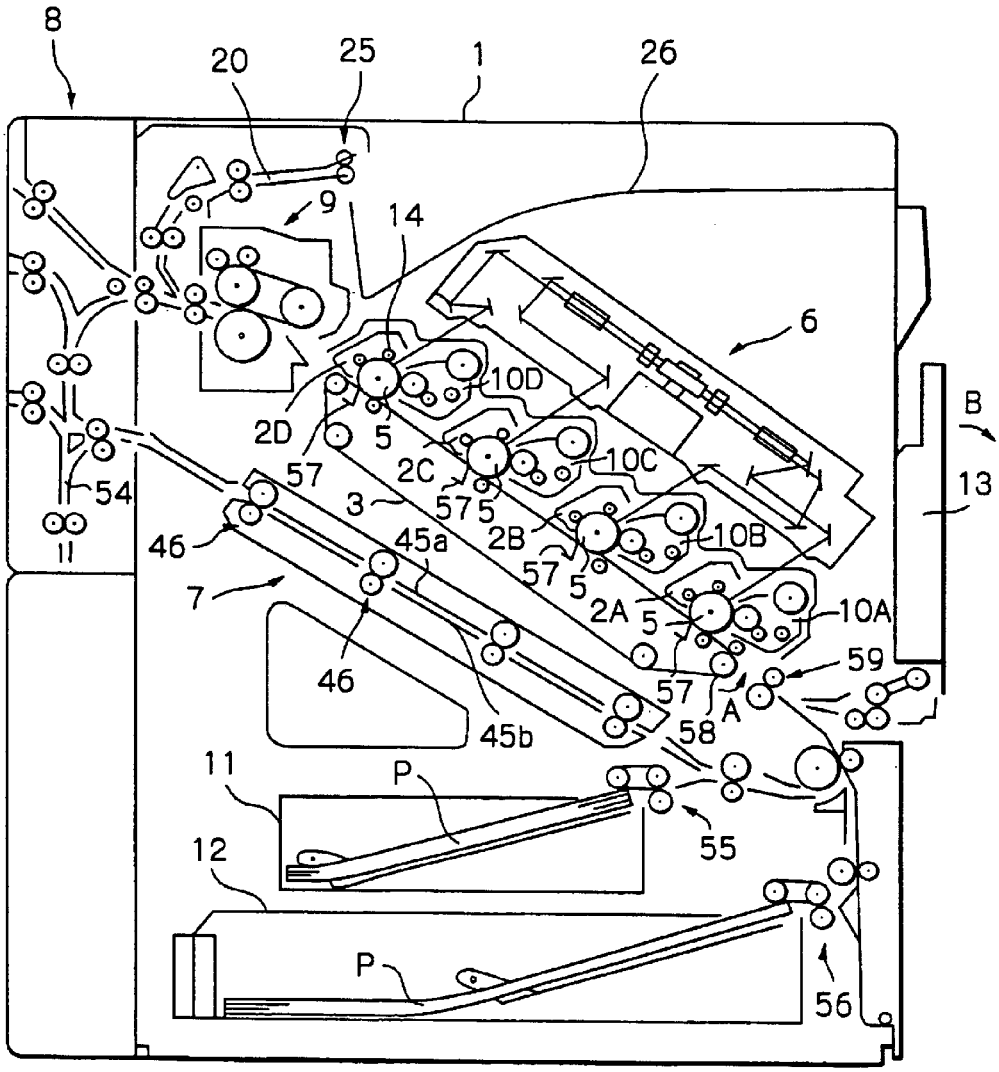
FIG. 4 is a front view showing an electrophotographic image forming apparatus including the charging device of FIG. 3.
Figure 5:
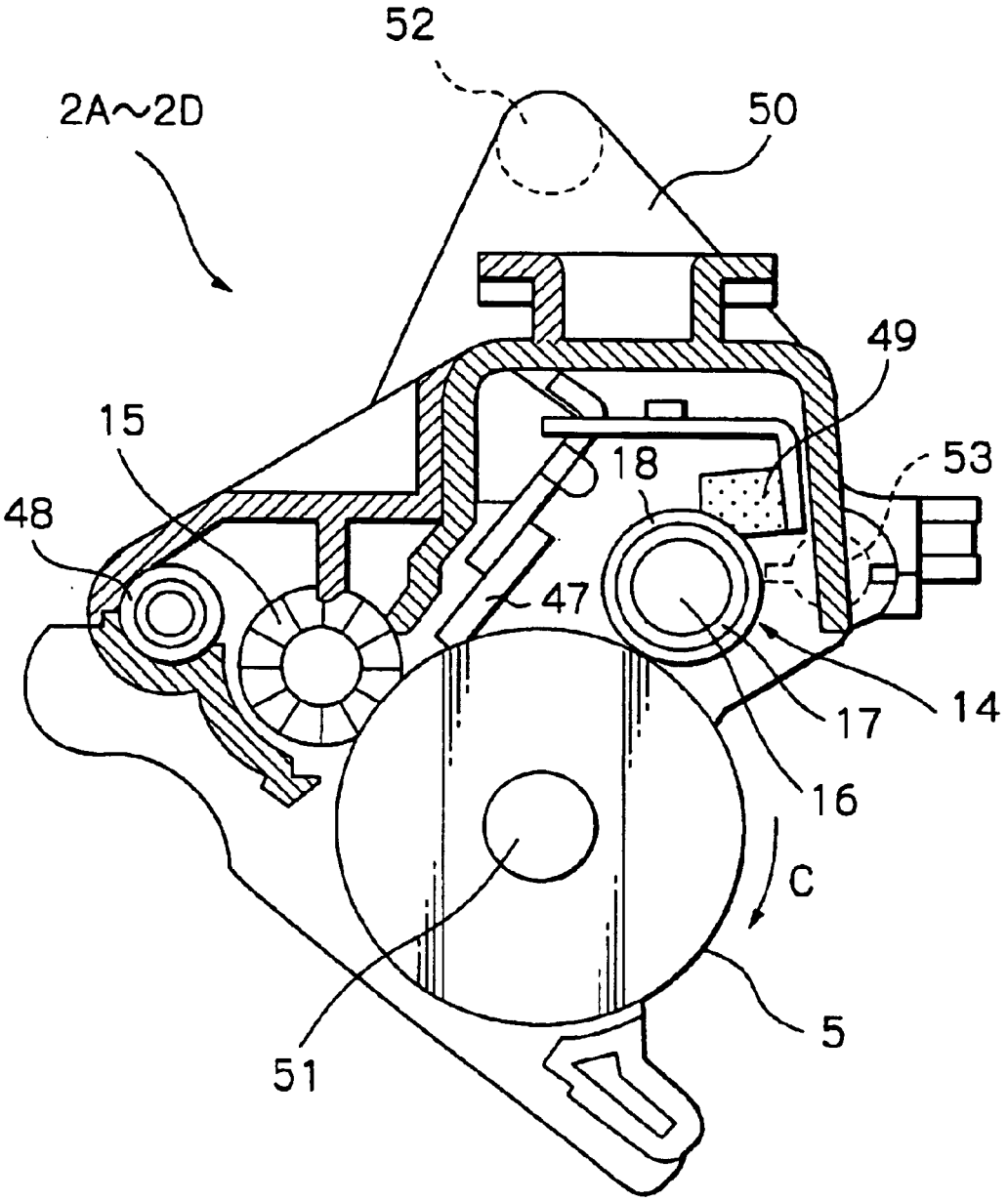
FIG. 5 is a partly sectional view showing a specific drum unit or image carrier unit included in the apparatus of FIG. 4.

Referring to FIG. 3, a charge roller included in a charging device embodying the present invention is shown. FIG. 4 shows a specific electrophotographic image forming apparatus to which the illustrative embodiment is applied. FIG. 5 shows a specific drum unit or image carrier unit included in the image forming apparatus. The drum unit accommodates a photoconductive drum, which is a specific form of an image carrier.

As shown in FIG. 4, the image forming apparatus is a small size, full-color image forming apparatus including a body 1. Four drum units 2A, 2B, 2C and 2D are disposed in and removable from the body 1. The drum units 2A through 2D each include a respective photoconductive drum 5. An image transfer belt 3 is positioned at substantially the center of the body 1 and passed over a plurality of rollers in such a manner as to be movable in a direction A. The drum units 2A through 2D are positioned above the image transfer belt 3 with their drums 5 contacting the upper surface of the belt 3, as viewed in FIG. 4. Developing units 10A, 10B, 10C and 10D, each storing toner of a particular color, are associated with the drum units 2A through 2D, respectively.

An optical writing unit 6 is positioned above the drum units 2A through 2D. A duplex print unit 7 is positioned below the drum units 2A through 2D. A reversal unit 8 is positioned at the left-hand side of the body 1, as viewed in FIG. 4, for selectively discharging a paper sheet P while reversing it or conveying the paper sheet P to the duplex print unit 7. The paper sheet P is a specific form of a recording medium.

A fixing unit 9 is positioned between the image transfer belt 3 and the reversal unit 8 in order to fix a toner image transferred to the paper sheet P. The paper sheet P reversed by the reversal unit 8 is driven out to a tray 26 by an outlet roller pair 25 via a reversal path 20. The paper sheet P is fed from either one of paper cassettes 11 and 12 located in the lower portion of the body 1. The paper cassettes 11 and 12 are positioned one above the other, and each is loaded with a stack of paper sheets P of a particular size. A manual feed tray 13 is mounted on the right side wall of the body 1 and openable in a direction B. By opening the manual feed tray 13, the operator of the apparatus is capable of feeding a special recording medium by hand.

The drum units 2A through 2D are identical in configuration and spaced from each other in the direction in which the paper sheet P is conveyed. In the illustrative embodiment, the drum units 2A through 2D are assigned to a yellow toner image, a magenta toner image, cyan toner image and a black toner image, respectively.

As shown in FIG. 5, the drum units 2A through 2D each include a charge roller or charging roller 14 and a brush roller or cleaning device 15 in addition to the drum 5, which is implemented by OPC (Organic PhotoConductor) in the illustrative embodiment. The charge roller 14 is made up of a metallic core 16 and an elastic member 17 covering the core 16. The charge roller 14 uniformly charges the surface of the drum 5. The charged surface of the drum 5 is optically scanned imagewise in order to form a latent image thereon. The brush roller 15 cleans the surface of the drum 5. If desired, only the charge roller 14 and drum 5 may be constructed into a single drum unit. In the illustrative embodiment, the drum 5 has a diameter of 30 mm.

Figure 6:
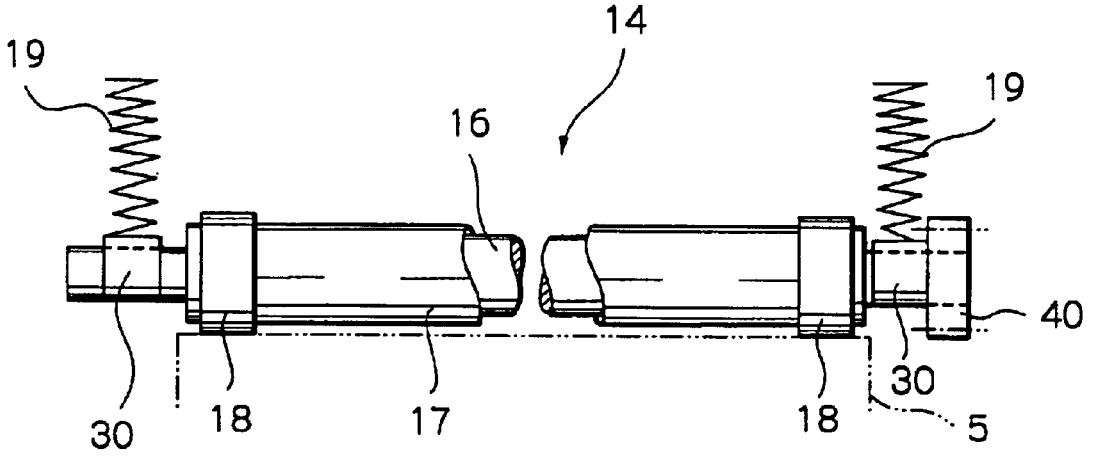
FIG. 6 is a front view showing the charge roller of FIG. 3 and springs pressing it.
Figure 7:
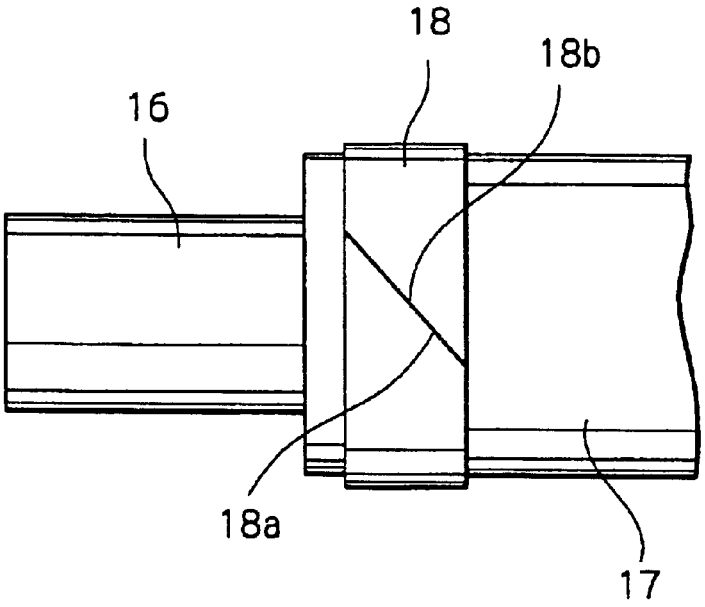
FIG. 7 is a fragmentary enlarged view showing the seam of a film wrapped around the charge roller of FIG. 6.

As shown in FIG. 6, the charge roller 14 includes a metallic core 16 and an elastic member 17 covering the core 16. The elastic member 17 is formed of, e.g., epichlorohydrin rubber and provided with a volume resistivity of $1\times10^3$ Ω·cm to $1\times10^8$ Ω·cm. Films 18 formed of, e.g., polyethylene terephthalate are wrapped around the opposite end portions of the elastic member 17. Specifically, as shown in FIG. 7, each film 18 is adhered to the elastic member 17 with obliquely cut ends 18*a* and 18*b* thereof contacting each other. As shown in FIG. 6, the films 18 contact the drum 5. Springs or biasing members 19 bias the opposite ends of the core 16 toward the drum 5 via slide bearings 30. A drive gear 40 is mounted on the right end of the core 16, as viewed in FIG. 6. A motor, not shown, causes the charge roller 14 to rotate at the same linear velocity as the drum 5 via the drive gear 40.

A power source, not shown, applies a voltage between the charge roller 14 and the drum 5, so that the charge roller 14 charges the surface of the drum 5. More specifically, the power source applies a DC voltage of −700 V to the core 16 by constant voltage control and, at the same time, applies an AC voltage to the core 16 by constant current control. Even when the gap between the elastic member 17 and the surface of the drum 5 (gap G, FIG. 3) varies, the above constant current control allows a voltage conforming to the variation to act on the core 16. This maintains the potential deposited on the drum 5 constant.

As shown in FIG. 3, the springs 19, pressing the charge roller 14, cause the elastic member 17 to deform. In the illustrative embodiment, the maximum deformation δ of the films 18, which deform along the periphery of the elastic member 17, is selected to be smaller than the thickness t of the films 18 in the radial direction of the charge roller 14.

The films 18 of the charge roller 14 may be caused to contact the drum 5 by the weight of the charge roller 14 in place of the biasing forces of the springs 19, if desired.

The core 16 of the charge roller 14 may have an outside diameter of 9 mm while the elastic member 17 may be implemented by a 1.5 mm thick rubber layer. In the illustrative embodiment each film 18 wrapped around the elastic member 17 has a thickness of 50±10 μm. The elastic member 17 has a rubber hardness of about 77° in JIS (Japanese Industrial Standards) A scale or 50° or above in terms of the test piece hardness of rubber itself.

The drum 5 shown in FIG. 5 is rotated in a direction C at a linear velocity of 185 mm/sec during monochromatic printing. During color printing, the drum 5 is selectively rotated at 125 mm/sec or 62.5 mm/sec stepwise.

The drum units 2A through 2D each further include a cleaning blade 47 whose edge is held in sliding contact with the drum 5 for scraping off toner left on the drum 5. The brush roller 15 transfers the toner scraped off by the cleaning blade 47 to an auger 48. The auger 48 in rotation conveys the collected toner, or waste toner, to a preselected toner collecting section not shown.

Each of the drum units 2A through 2D additionally includes a charge roller cleaner 49 held in contact with the elastic member 17 of the charge roller 14 and formed of, e.g., sponge. The charge roller cleaner 49 removes toner and dust that fly about within the body 1, FIG. 4, and deposit on the surface of the elastic member 17.

The drum units 2A through 2D each is provided with a main reference portion 51 to be positioned relative to the body 1, FIG. 4, when mounted to or dismounted from the body 1. A bracket 50 is provided with a front auxiliary reference portion 52 and a rear auxiliary reference portion 53. The main reference portion 51 and auxiliary reference portions 52 and 53 allow the drum unit to be surely positioned relative to the body 1.

The developing units 10A through 10D shown in FIG. 4 are identical in configuration, and each stores a two-ingredient type developer, i.e., a toner and carrier mixture. Specifically, the developing units 10A through 10D respectively store a developer containing yellow toner, a developer containing magenta toner, a developer container cyan toner, and a developer containing black toner.

Figure 8:
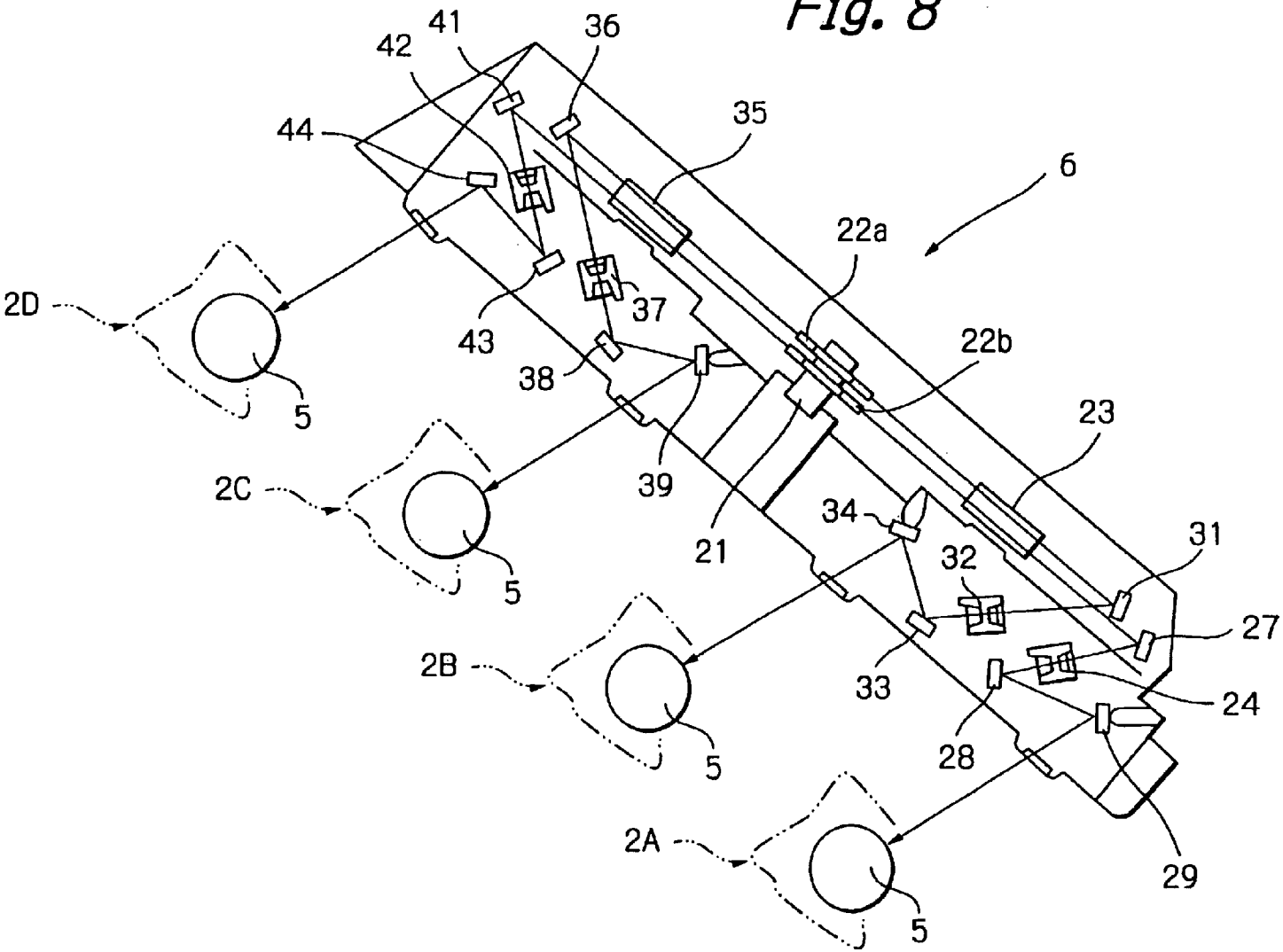
FIG. 8 is a view showing an optical writing unit also included in the apparatus of FIG. 4.

FIG. 8 shows the optical writing unit 6 in detail. As shown, the optical writing unit 6 includes a polygon motor 21 having two polygonal mirrors 22*a* and 22*b* each having six faces and emits a single beam for color printing or two beams for monochromatic printing. Specifically, a laser diode or light source, not shown, emits a laser beam in accordance with image data. The polygonal mirror 22*a*, which is rotated by the polygon motor 21, reflects beams representative of yellow image data and magenta image data to the right. The polygonal mirror 22*b*, which is also rotated by the polygon motor 21 reflects beams representative of cyan image data and black image data to the left.

More specifically, the beams representative of yellow image data and magenta image data are passed through a double-layer f-θ lens 23. The beam assigned to yellow is then reflected by a mirror 27 and incident to the drum 5 of the drum unit 2A via an elongate WTL 24 and mirrors 28 and 29. Likewise, the beam assigned to magenta is incident to the drum 5 of the drum unit 2B via an elongate WTL 32 and mirrors 33 and 34. On the other hand, the beams representative of cyan image data and black image data are passed through a double-layer f-θ lens 35. The beam assigned to cyan is then reflected by a mirror 36 and incident to the drum 5 of the drum unit 2C via an elongate WTL 37 and mirrors 38 and 39. Likewise, the beam assigned to black is incident to the drum 5 of the drum unit 2D via an elongate WTL 42 and mirrors 43 and 44.

Referring again to FIG. 4, the duplex print unit 7 includes a pair of guides 45*a* and 45*b* and a plurality of (four in the illustrative embodiment) roller pairs 46. In a duplex print mode for forming images on both sides of the paper sheet P, the paper that carries an image on one side thereof is conveyed into the reversal path 54 and switched back to the duplex print unit 7 thereby. The duplex print unit 7 again feeds the paper sheet P toward the image forming section where the drum units 2A through 2D are arranged.

The reversal unit 8 includes a plurality of roller pairs and a plurality of guides. The reversal unit 8 conveys, in the duplex print unit, the paper sheet P toward the duplex print unit 7 while reversing it, as stated above, or discharges the paper sheet P without reversing it or after reversing it. Pick-up sections 55 and 56 are respectively associated with the cassettes 11 and 12, and each picks up a paper sheet P while separating it from the other sheets P.

The small-size printer having the above configuration uses a roller curvature type of sheet separation system implemented by the image transfer belt 3. Four image transfer brushes 57 are positioned between the opposite runs of the image transfer belt 3, and each faces particular one of the drums 5.

In operation, the drums 5 are rotated clockwise, as viewed in FIG. 4, while the charge rollers 14 each charge the surface of the associated drum 5. The optical writing unit 6 scans the charged surface of the drum 5 of the drum unit 2A with a laser beam in accordance with yellow image data. Likewise, the optical writing unit 6 scans the charged surface of the drum 5 of the drum unit 2B with a laser beam in accordance with magenta image data. Further, the optical writing unit 6 scans the charged surfaces of the drums 5 of the drum units 2C and 2D with laser beams in accordance with cyan and black image data, respectively. As a result, latent images each corresponding to a particular color are formed on the drums 5.

When the latent image formed on the drum 5 of the drum unit 2A reaches the developing unit 10A, the developing unit 10A develops the latent image with yellow toner to thereby form a corresponding toner image. This is also true with the other latent images except that they are developed in magenta, cyan and black by the developing units 10B, 10C and 10D.

The paper sheet P is fed from either one of the cassettes 11 and 12 toward a registration roller pair 59. The registration roller pair 59 conveys the paper sheet P toward a position between the drum 5 of the drum unit 2A and the image transfer belt 3 at such a timing that the leading edge of the paper sheet P meets the leading edge of the yellow toner image formed on the drum 5. At this instant, an attraction roller 58 that adjoins the inlet end of the image transfer belt 3 charges the paper sheet P to positive polarity and thereby electrostatically attracts the paper sheet P onto the belt 3. The belt 3, rotating in the direction A, conveys the paper sheet P while electrostatically retaining it thereon. As a result, the yellow, magenta, cyan and black toner images are sequentially transferred from the drums 5 of the drum units 2A through 2D to the upper surface of the paper sheet P, completing a full-color toner image.

The fixing unit 9 fixes the full-color toner image on the paper sheet P with heat and pressure. The paper sheet, or full-color print, P is then routed through a path assigned to a mode selected. Specifically, the paper sheet P is reversed and then discharged to the tray 26 or is discharged straight via the reversal unit 8. Further, in the duplex print mode, the paper sheet P is driven into the reversal path 54, switched back thereby, conveyed to the duplex print unit 7, again fed to the image forming section, and then discharged. The procedure described above is repeated a number of times corresponding to a desired number of prints.

In the illustrative embodiment, the springs 19, FIG. 6, press the charge roller 14 with the result that the elastic member 17 deforms due to compression, as described with reference to FIG. 3. The maximum deformation δ of the films 18, which deform along the periphery of the elastic member 17, is selected to be smaller than the thickness t of the films 18 in the radial direction of the charge roller 14, as stated earlier.

In the above condition, the gap G is formed between the elastic member 17 and the drum 5. The gap G prevents the portion of the elastic member 17, which corresponds to an image forming region, other than the opposite end portions from contacting the drum 5. This successfully prevents the toner and impurities left on the drum 5 after the image transfer from being transferred to the charge roller 14. At the same time, substances contained in the elastic member 17 are prevented from oozing out and depositing on the drum 5. The deposition of such substances on the drum 5 occurs in the contact type charging device, as discussed previously.

The charge roller 14, particularly its intermediate portion in the axial direction, bends toward the drum 5 due to the weight of the core 16, the biasing forces of the springs 19, displacement ascribable to the axis, linearity of the roller 14 and drum 5, and so forth. Such a bend of the charge roller 14 occurs even if the gap between the elastic member 17 around the films 18 and the drum 5 is, e.g., 50 μm. Usually, therefore, the gap G shown in FIG. 3 is smaller than 50 μm at the intermediate portion of the elastic member 17. It follows that when the films 18 are relatively thin, the intermediate portion of the charge roller 4 is likely to contact the drum 5. However, in the illustrative embodiment, the maximum deformation δ of the elastic member 18 in the radial direction of the charge roller 14 is selected to be smaller than the thickness t of the films 18, as stated earlier. Therefore, although the intermediate portion of the charge roller 14 may contact the drum 5, the contact is only momentary in the direction of rotation, i.e., it does not continue. The illustrative embodiment is therefore free from the drawbacks of the contact type charging device.

Experiment 1

Experiment 1 was conducted to determine the initial charging ability, long-term charging ability and charging noise in the above-described condition unique to the illustrative embodiment. For Experiment 1, use was made of a charge roller configured as Sample #1 shown in FIG. 9. Sample #1 included a core having a diameter of 9 mm and formed of copper whose surface was plated with nickel (SUM-Ni plating). An elastic member covering the core was formed of epichlorohydrin rubber and had a volume resistivity of $1\times10^5$ Ω·cm. Also, the elastic member had a thickness of 1.5 mm, a length of 324 mm, and a hardness of 75° in JIS A scale. Films wrapped around the elastic member were implemented by Daitack PF025-H (trade name) available from DAINIPPON INK & CHEMICALS, Inc. and were 60 μm thick and 8 mm wide. Springs had a load of 2.5N×2 each.

As FIG. 10 indicates, Sample #1 showed the maximum deformation of 20 μm and had a nip width N of 1 mm. Sample #1 caused no irregularity to occur as to initial charging ability. As for long-term charging ability, Sample #1 caused no defective charging to occur even after 150,000 prints were produced. Further, Sample #1 produced no initial charging noise.

Experiment 2

Several charge rollers different in the thickness, hardness and so forth of the elastic member 17, FIG. 6, were prepared in order to evaluate them as to initial charging ability, long-term charging ability and charging noise.

Specifically, Experiments 2 was conducted with Samples #2 through #5 listed in FIG. 9. Samples #2 through #5 each included a metallic core having an outside diameter of 8 mm and an elastic member formed of epichlorohydrin rubber whose volume resistivity was $1\times10^5$ Ω·cm. The elastic member of Sample #2 was 2 mm thick while the elastic members of Samples #3 through #5 were 3 mm thick. Films wrapped around the elastic member were 85 μm to 10 μm thick and 8 mm wide. Sample #3 was a comparative example not provided with films.

Samples #2, #4 and #5 exhibited the maximum deformations δ, FIG. 3, and nip widths N shown in FIG. 10. As for initial charging ability, Sample #4 whose film thickness was 105 μm caused abnormal discharge and therefore an image defect to occur around the films at the roller period. Although the image defect continuously appeared throughout 150,000 prints, it did not appear thereafter. Sample #4 was therefore acceptable (circle) as to long-term durability.

Sample #3 lacking films caused irregular charging to occur due to filming on the charge roller when 20,000 prints were produced. Sample #3 was therefore not acceptable as to long-term durability (cross).

Sample #5 whose film thickness was 100 μm sometimes caused impurities to be nipped between the films and the photoconductive drum during durability test. The impurities enlarged the gap between the films and the photoconductive drum and thereby brought about defective images. However, when the impurities were removed, an adequate image was recovered (circle).

Sample #3 caused initial charging noise to occur and was not acceptable in this respect (cross).

As FIGS. 9 and 10 indicate, the required initial charging ability, long-term charging ability and charging noise can all be satisfied if the films 18 wrapped around the opposite end portions of the elastic member 17 are 100 μm thick or less.

Further, the results of experiments conducted with Samples #1 and #2 indicate that if the rubber thickness of the elastic member 17 is 2.0 mm or less at room temperature, there can be satisfied the initial charging ability, long-term charging ability and charging noise. Moreover, the results of experiments conducted with Samples #1 and #2 indicate that if the hardness or roller hardness of the elastic member 17 is 65° or above at room temperature, as measured by a JIS-A hardness gauge, there can also be satisfied the above three different conditions.

Figure 11:
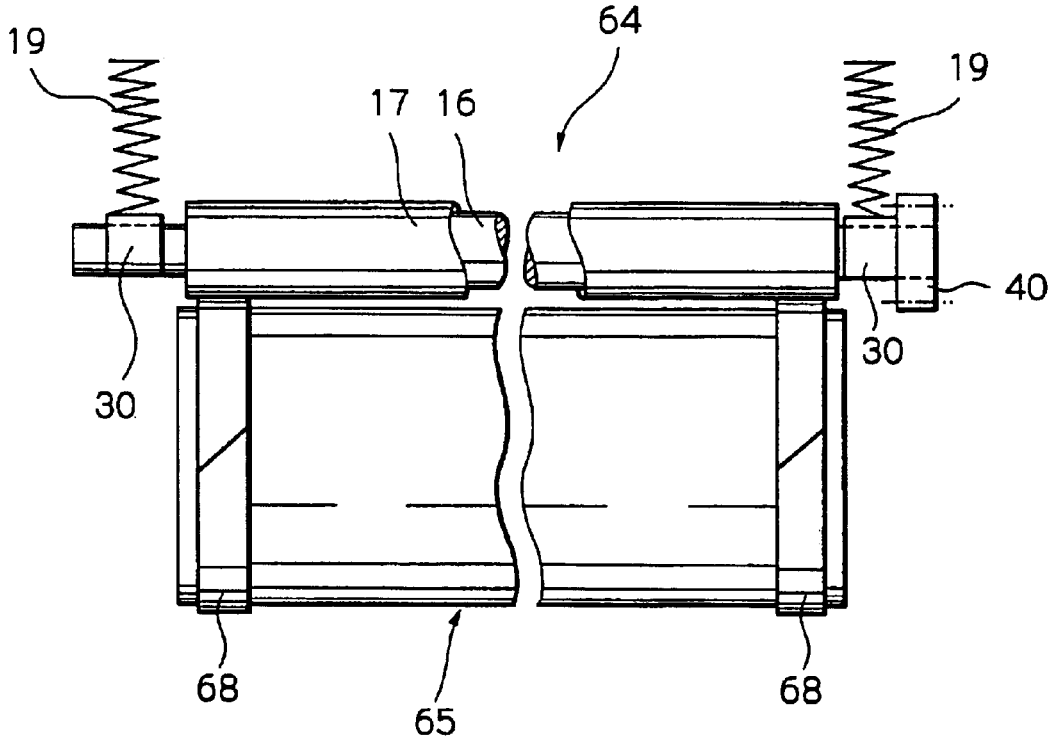
FIG. 11 is a view similar to FIG. 6, showing an alternative embodiment of the present invention together with a photoconductive drum.

FIG. 11 is a view similar to FIG. 6, showing an alternative embodiment of the present invention. In FIGS. 6 and 11, identical reference numerals designate identical structural elements. As shown, this embodiment differs from the previous embodiment in that films 68 are wrapped around the opposite end portions of a photoconductive drum 65 in order to form a gap between the drum 65 and a charge roller 64. In the illustrative embodiment, the charge roller 64 is made up of the core 16 and elastic member 17 only. Again, the charge roller 64 uniformly charges the surface of the drum 65, so that a latent image can be formed on the drum 65.

More specifically, the films 68 are wrapped around the portions of the drum 65 corresponding to the opposite end portions of the charge roller 64. The opposite end portions of the charge roller 64 are held in contact with the films 68. The springs 19 press the charge roller 64 against the drum 65 as in the previous embodiment. In this condition, a voltage is applied between the charge roller 64 and the drum 65, causing the charge roller 64 to charge the drum 65.

Figure 12:
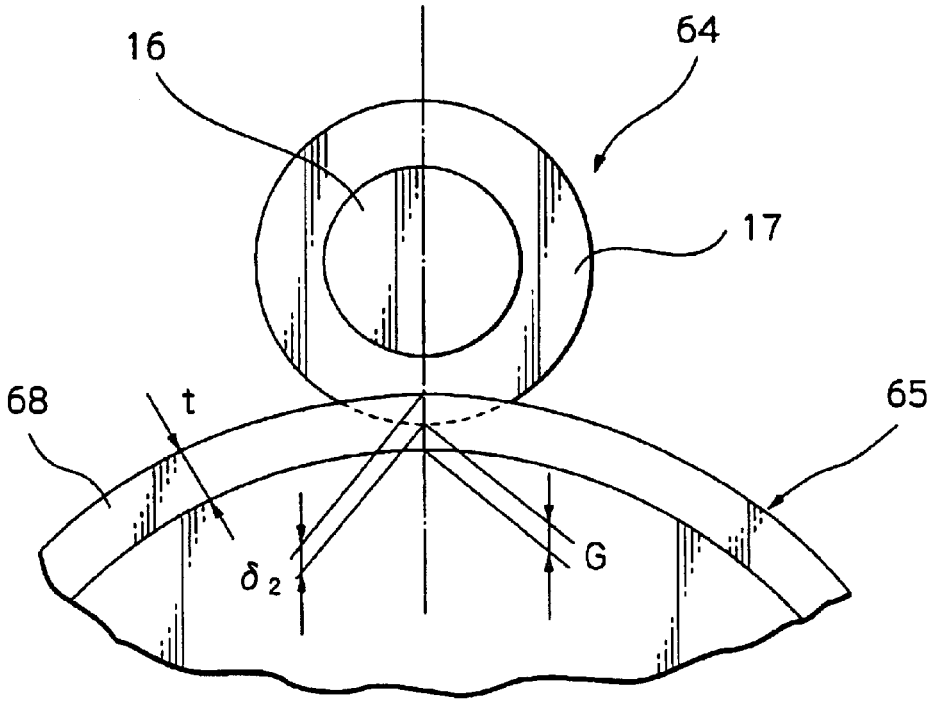
FIG. 12 is a side elevation demonstrating the deformation of an elastic member included in a charge roller, which is shown in FIG. 11.

As shown in FIG. 12, the springs 19 cause the elastic member 17 to deform by the maximum amount of $\delta_2$ in the radial direction of the charge roller 64. Again, the maximum deformation $\delta_2$ is selected to be smaller than the thickness t of the films 68.

Figure 13:
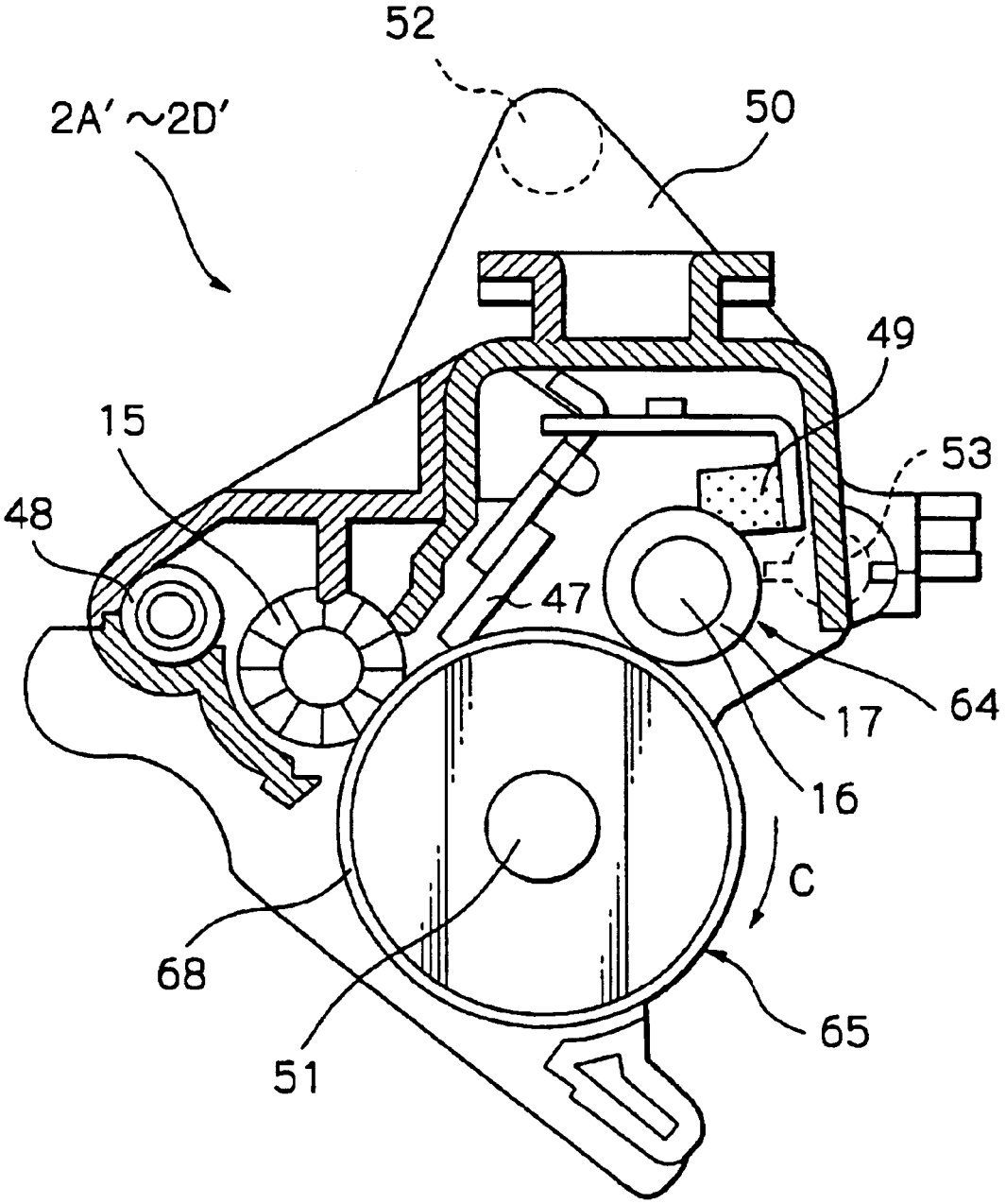
FIG. 13 is a view similar to FIG. 5, showing a drum unit including the embodiment of FIG. 11 together with a photoconductive drum.

In the illustrative embodiment, too, the films 68 each are 100 μm thick or below. FIG. 13 shows one of drum units 2A' through 2D' in which the drum 65 with the films 68 and charge roller 64 are built. Again, the drum units 2A' through 2D' are identical with each other except for the color of a toner image to be formed on the drum 65.

Figure 14:
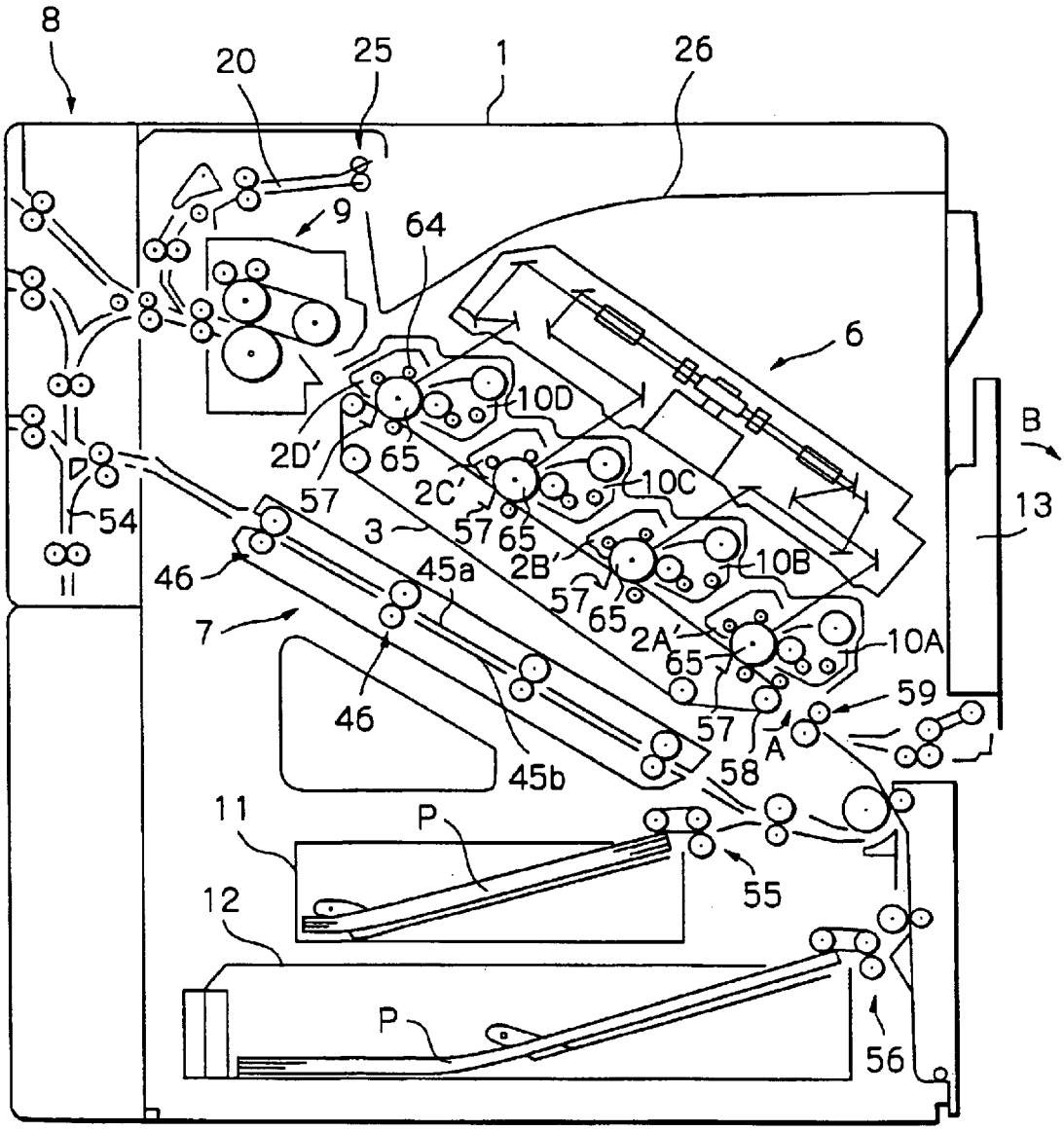
FIG. 14 is a front view showing a small-size printer including the drum unit of FIG. 13.

Specifically, the drum units 2A' through 2D' each include a brush roller 15 and a cleaning blade 47, which constitute a cleaning device for cleaning the surface of the drum 6, in addition to the charge roller 64 and drum 65. The drum units 2A' through 2D' each are movable from the apparatus body 1 shown in FIG. 14 independently of each other. The image forming apparatus shown in FIG. 14 is identical in configuration with the image forming apparatus of FIG. 4 and will not be described specifically in order to avoid redundancy.

Figure 15:
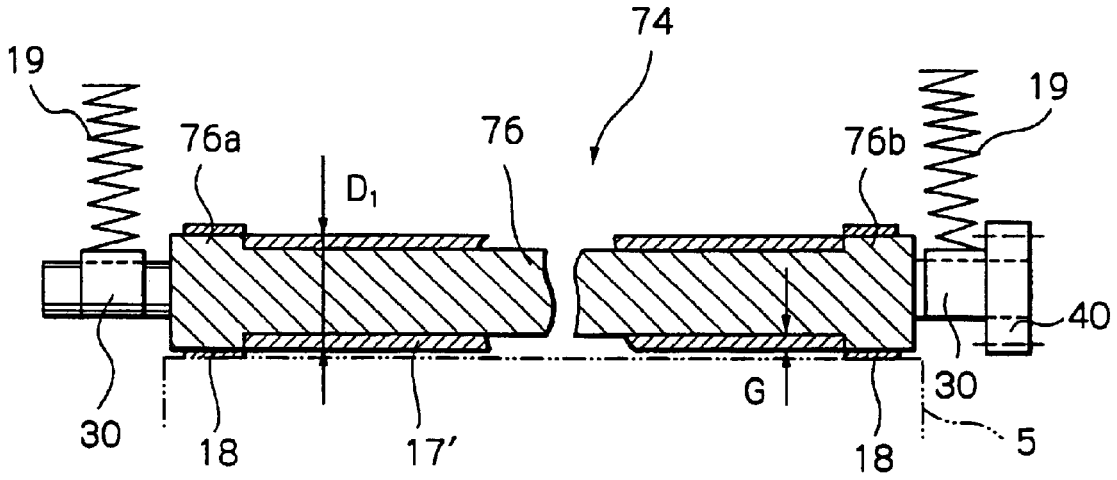
FIG. 15 is a front view showing another specific configuration of the charge roller.

FIG. 15 shows another specific configuration of the charging roller. As shown, the charging roller, generally 74, faces the surface of the drum 5 and may serve as any one of a charge roller, an image transfer roller, a discharge roller and a developing roller, as desired.

The charging roller 74 includes a metallic core 76 formed of SUM-Ni plating mentioned earlier. An elastic member 17' covers the surface of the core 76 and is formed of epichlorohydrin rubber whose volume resistivity is $1\times10^3$ Ω·cm to $1\times10^8$ Ω·cm. In the illustrative embodiment, the core 76 has opposite end portions 76*a* and 76*b* larger in diameter than the intermediate portion in the axial direction of the core 76. The elastic member 17' is positioned in the intermediate portion of the core 76 and has an outside diameter $D_1$ equal to the outside diameter of the larger diameter portions 76*a* and 76*b*. The films 18, FIG. 6, are wrapped around the larger diameter portions 76*a* and 76*b* and affixed thereto by adhesive.

In the configuration shown in FIG. 15, despite that the springs 19 press the opposite end portions of the core 76 toward the drum 5, the larger diameter portions 76*a* and 76*b* do not deform like the elastic member 17 of the charge roller 14, FIG. 4, does. This is because the films 18 are directly wrapped around and affixed to the larger diameter portions 76*a* and 76*b*. It follows that the gap G between the charging roller 74 and the drum 5 varies little and remains constant despite the biasing forces of the springs 19. The charging roller 74 is therefore advantageously applicable to the small-size printer shown in FIG. 4 as a charge roller.

Also, assume that the charging roller 74 is implemented as an image transfer roller that electrostatically transfers a toner image from a photoconductive element to a paper sheet when applied with a voltage. Then, the roller 74 insures stable image transfer. Moreover, because the portion of the roller 74 corresponding to the toner image does not contact the photoconductive element, it is free from contamination ascribable to residual toner otherwise transferred from the photoconductive element. This successfully protects the rear of a paper sheet from contamination.

Furthermore, assume that the roller 74 is implemented as a discharge roller for dissipating potential left on the photoconductive element after image transfer when applied with a voltage. Then, the roller 74 maintains the gap between it and the photoconductive element constant, insuring stable discharge.

Moreover, when the roller 74 is applied to a developing roller, it insures a gap between the portion of the developing roller expected to carry toner and the surface of the photoconductive element constant in accordance with the thickness of the films 18. The roller 74 therefore insures desirable development.

Figure 16:
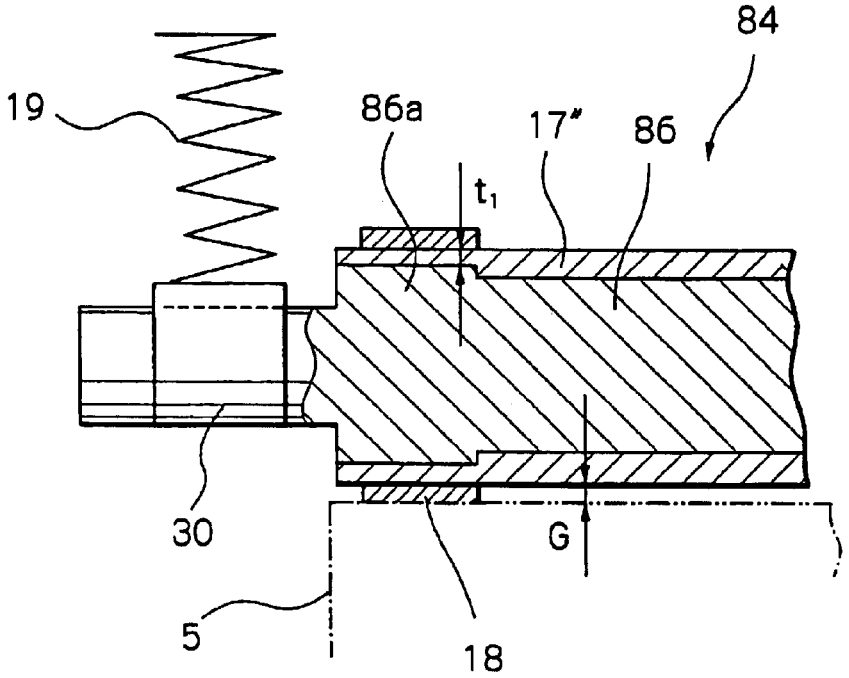
FIG. 16 is a fragmentary enlarged view showing still another specific configuration of the charge roller.

FIG. 16 shows one end portion of still another specific configuration of the charging roller. As shown, the charging roller, labeled 84, includes a core 86 having opposite end portions 86*a* and 86*b* (only 86*a* is shown) larger in diameter than the intermediate portion in the axial direction of the roller 84. An elastic member 17" is formed of epichlorohydrin rubber and has a volume resistivity of $1\times10^3$ Ω·cm to $1\times10^8$ Ω·cm. The elastic member 17" provided on the core 86 has the same outside diameter throughout the axial dimension of the core 86, i.e., from the larger diameter portion 86*a* to the larger diameter portion 86*b*. The films 18 (only one is shown) are wrapped around and adhered to the portions of the elastic member 17" corresponding to the larger diameter portions 86*a* and 86*b* of the core 86.

In the charge roller 84, the portions of the elastic member 17" underlying the films 18 have a thickness $t_1$ smaller than the other portion due to the larger diameter portions 86*a* and 86*b*. Therefore, despite that the springs 19 press the opposite end portions of the core 86 toward the drum 5, the thinner portions of the elastic member 17" deform little, compared to the charge roller 14 of FIG. 6 lacking the larger diameter portions 86*a* and 86*b*. The charge roller 86 therefore causes the gap G between it and the drum 5 to deform little despite the deformation of the elastic member 17", maintaining the gap G constant. It follows that the charging roller 86 insures desirable charging when applied to the charge roller of the small-size printer shown in FIG. 4.

Again, the charging roller 84 may be applied to an image transfer roller, a discharge roller or a developing roller in order to implement desirable image transfer, discharge or development.

When the charging roller 14 shown in FIG. 6 is implemented as an image transfer roller, a discharge roller or a developing roller, the films 18 should preferably be 100 μm thick or less, as indicated by the results of experiments shown in FIGS. 9 and 10. Also, the elastic member should preferably be 2.0 mm or below at room temperature and have a hardness of 65° or above at room temperature. With this configuration, the charging roller 14 maintains the gap between it and the photoconductive element stable.

Figure 17:
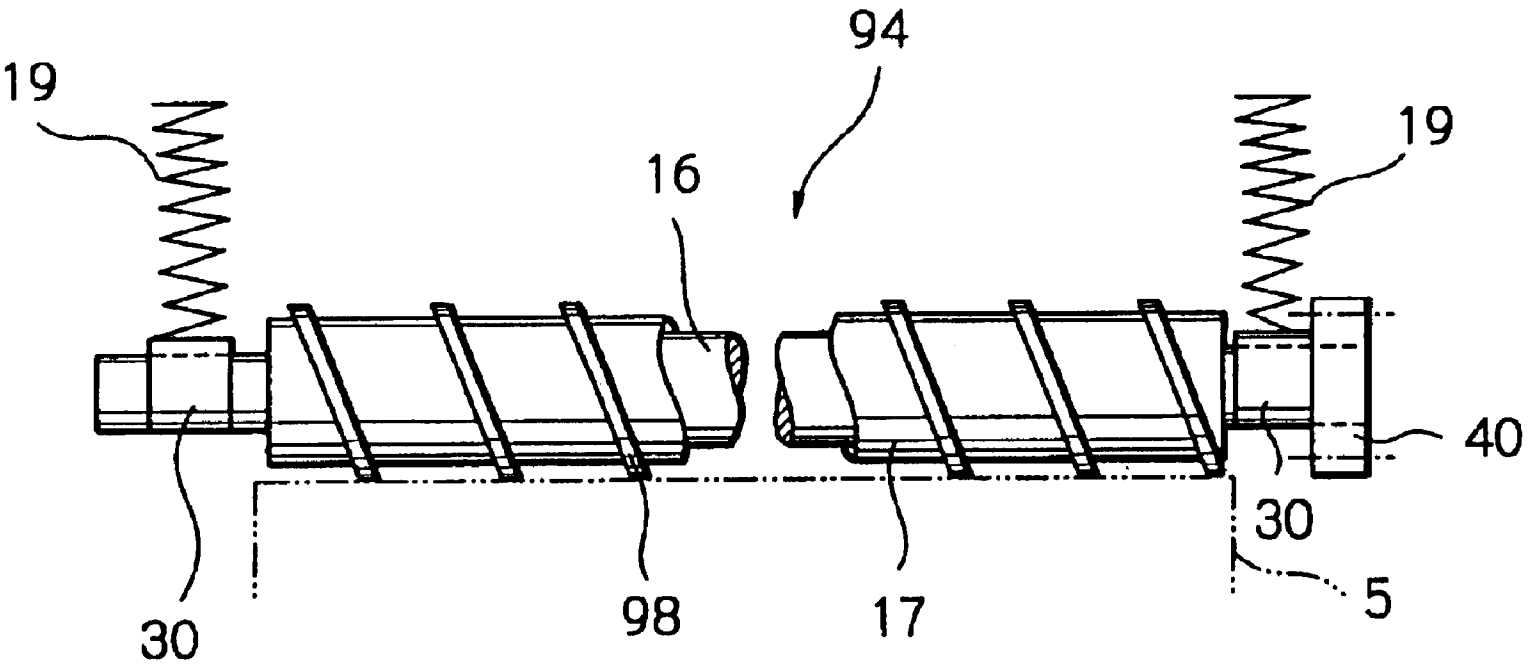
FIG. 17 is a front view showing a further specific configuration of the charge roller.

FIG. 17 shows a further specific configuration of the charging roller. As shown, the charging roller, labeled 94, is identical with the charge roller 14 of FIG. 6 except that a strip-like spacer member 98 is spirally wrapped around the elastic member 17. In FIGS. 6 and 17, identical reference numerals designate identical structural elements. The spacer member 98 is formed of, e.g., polyethylene terephthalate in which carbon is dispersed for providing the member 98 with conductivity. If desired, the stripe-like spacer member 98 may be replaced with a wire-like spacer member.

In summary, it will be seen that the present invention achieves various unprecedented advantages, as enumerated below.

(1) The maximum deformation of films ascribable to the deformation of an elastic member due to compression is selected to be smaller than the thickness of the films in the radial direction of a charge roller. Therefore, even if the charge roller approaches a body to be charged by the deformation of the elastic member, a preselected gap is insured between the elastic member and the body to be charged.

(2) Therefore, even if the films are provided with a thickness small enough to prevent abnormal discharge from occurring around the films, toner left on the body to be charged after image transfer is prevented from being transferred to the charge roller. This obviates defective charging ascribable to the contamination of the charge roller.

(3) Further, assume that the charge roller is left unused over a long period of time with the elastic member being pressed against the body to be charged. Then, substances contained in the elastic member are prevented from oozing out to the surface of the roller and contaminating the body to be charged.

(4) The films each are as thin as 100 μm or below and obviate defective images ascribable to abnormal discharge in the initial stage of operation.

(5) The elastic member is 2.0 mm thick or below at room temperature. This not only obviates defective images ascribable to abnormal discharge, but also insures desirable charging over a long period of time. In addition, such an elastic member obviates initial charging noise.

(6) The elastic member has a hardness of 65° or above at room temperature. This is also successful to achieve the above advantage (5).

(7) Films are wrapped around the opposite end portions of an image carrier while the charge roller is held in contact with the films. When the opposite end portions of the charge roller, contacting the films, cause its elastic member to deform due to compression, the maximum deformation of the elastic member, as measured in the radial direction of the charger roller, is smaller than the thickness of the films. A preselected gap can therefore be maintained between the elastic member and the image carrier.

(8) It follows that the elastic member of the charge roller does not constantly contact the image carrier. This is also successful to achieve the advantage (2).

(9) Even when the films deform in the radial direction of the charge roller due to the deformation of the elastic member, the maximum deformation of the films is smaller than the thickness thereof. Therefore, even if the charge roller approaches the body to be charged by the deformation, a preselected gap can be maintained between the elastic member and the body to be charged.

(10) Therefore, toner left on the body to be charged after image transfer is prevented from being transferred to the charge roller.

(11) The films are directly wrapped around larger diameter portions of the core of the charge roller. Therefore, despite that the charge roller is pressed toward the body to be charged, the larger diameter portions do not deform due to compression like the elastic member does. This is also successful to insure a preselected gap between the charge roller and the body to be charged.

(12) The portions of the elastic member corresponding to the films, which are wrapped around the larger diameter portions, are thinner than the other portion. The above portions of the elastic member therefore deform little despite that the charge roller is pressed toward the body to be charged, insuring a preselected gap between the charge roller and the body to be charged.

(13) The charging roller is implemented as a charge roller for charging a photoconductive element and insures desirable charging.

(14) A stripe-like or a wire-like spacer member is spirally wrapped around the elastic member, insuring a preselected gap between the elastic member and the body to be charged.

Various modifications will become possible for those skilled in the art after receiving the teachings of the present disclosure without departing from the scope thereof.

What is claimed is:

1. A charging device for charging a surface of a body to be charged, comprising:

a charge roller comprising a metallic core and an elastic member covering a surface of said core; and films respectively wrapped around opposite end portions of said charge roller such that said charge roller contacts the body to be charged via said films, wherein a voltage is applied between said charge roller and said body to be charged;

wherein when said elastic member deforms due to compression ascribable to contact of said charge roller with the body to be charged, said films deform along an outer periphery of said elastic member by a maximum amount, as measured in a radial direction of said charge roller, which is smaller than a thickness of said films.

2. A charging device as claimed in claim 1, wherein said films have a thickness of 100 $\mu$m or below each.

3. A charging device as claimed in claim 2, wherein said charge roller is pressed by biasing members such that said films remain in contact with the body to be charged.

4. A charging device as claimed in claim 2, wherein said elastic member has a harness of 65° or above at a room temperature.

5. A charging device as claimed in claim 4, wherein said charge roller is pressed by biasing members such that said films remain in contact with the body to be charged.

6. A charging device as claimed in claim 2, wherein said elastic member has a thickness of 2.0 mm or below at a room temperature.

7. A charging device as claimed in claim 6, wherein said charge roller is pressed by biasing members such that said films remain in contact with the body to be charged.

8. A charging device as claimed in claim 6, wherein said elastic member has a harness of 65° or above at a room temperature.

9. A charging device as claimed in claim 8, wherein said charge roller is pressed by biasing members such that said films remain in contact with the body to be charged.

10. A charging device as claimed in claim 1, wherein said elastic member has a thickness of 2.0 mm or below at a room temperature.

11. A charging device as claimed in claim 10, wherein said charge roller is pressed by biasing members such that said films remain in contact with the body to be charged.

12. A charging device as claimed in claim 10, wherein said elastic member has a harness of 65° or above at a room temperature.

13. A charging device as claimed in claim 12, wherein said charge roller is pressed by biasing members such that said films remain in contact with the body to be charged.

14. A charging device as claimed in claim 1, wherein said charge roller is pressed by biasing members such that said films remain in contact with the body to be charged.

15. A charging device as claimed in claim 1, wherein said elastic member has a harness of 65° or above at a room temperature.

16. A charging device as claimed in claim 15, wherein said charge roller is pressed by biasing members such that said films remain in contact with the body to be charged.

17. In an image forming apparatus including a charging device for charging a surface of a body to be charged, said charging device comprising a charge roller made up of a metallic core, an elastic member covering a surface of said core, and films respectively wrapped around opposite end portions of said charge roller such that said charge roller contacts said body to be charged via said films, a voltage being applied between said charge roller and said body to be charged, when said elastic member deforms due to compression ascribable to contact of said charge roller with said body to be charged, said films deform along an outer periphery of said elastic member by a maximum amount, as measured in a radial direction of said charge roller, which is smaller than a thickness of said films.

18. In an image forming apparatus including a charge roller, which comprises a metallic core and an elastic member covering said core, for charging a surface of a drum-like image carrier in response to a voltage applied between said charge roller and said image carrier to thereby allow a latent image to be optically formed on said surface, films are respectively wrapped around portions of said image carrier corresponding to opposite end portions of said charge roller such that said opposite end portions of said charge roller respectively contact said films, and portions of said elastic member deformed due to compression ascribable to contact of said charge roller with said image carrier have a maximum deformation, as measured in a radial direction of said charge roller, which is smaller than a thickness of said films.

19. A charging device as claimed in claim 18, wherein said charge roller is pressed by biasing members such that the opposite end portions thereof respectively remain in contact with said films.

20. A charging device as claimed in claim 18, wherein said films have a thickness of 100 $\mu$m or below each.

21. A charging device as claimed in claim 20, wherein said charge roller is pressed by biasing members such that the opposite end portions thereof respectively remain in contact with said films.

22. In an image carrier unit removably mounted to a body of an image forming apparatus and comprising a charge roller, which comprises a metallic core and an elastic member covering said core, for charging a surface of an image carrier in response to a voltage applied between said charge roller and said image carrier to thereby allow a latent image to be optically formed on said surface, films are respectively wrapped around opposite end portions of said charge roller such that said charge roller contacts said image carrier via said films, and when said elastic member deforms due to compression ascribable to contact of said charge roller with said body to be charged, said films deform along an outer periphery of said elastic member by a maximum amount, as measured in a radial direction of said charge roller, which is smaller than a thickness of said films.

23. A charging device as claimed in claim 22, wherein said films have a thickness of 100 $\mu$m or below each.

24. A charging device as claimed in claim 23, said elastic member has a harness of 65° or above at a room temperature.

25. A charging device as claimed in claim 23, wherein said elastic member has a thickness of 2.0 mm or below at a room temperature.

26. A charging device as claimed in claim 25, said elastic member has a harness of 65° or above at a room temperature.

27. A charging device as claimed in claim 22, said elastic member has a harness of 65° or above at a room temperature.

28. A charging device as claimed in claim 22, wherein said elastic member has a thickness of 2.0 mm or below at a room temperature.

29. A charging device as claimed in claim 28, said elastic member has a harness of 65° or above at a room temperature.

30. In an image carrier unit removably mounted to a body of an image forming apparatus and comprising a charge roller, which comprises a metallic core and an elastic member covering said core, for charging a surface of an image carrier in response to a voltage applied between said charge roller and said image carrier to thereby allow a latent image to be optically formed on said surface, films are respectively wrapped around portions of said image carrier corresponding to opposite end portions of said charge roller such that said opposite end portions of said charge roller respectively contact said films, and portions of said elastic member deformed due to compression ascribable to contact of said charge roller with said image carrier have a maximum deformation, as measured in a radial direction of said charge roller, which is smaller than a thickness of said films.

31. In an electrophotographic image forming apparatus including an image carrier unit removably mounted to a body of an image forming apparatus and comprising a charge roller, which comprises a metallic core and an elastic member covering said core, for charging a surface of an image carrier in response to a voltage applied between said charge roller and said image carrier to thereby allow a latent image to be optically formed on said surface, films are respectively wrapped around opposite end portions of said charge roller such that said charge roller contacts said image carrier via said films, and when said elastic member deforms due to compression ascribable to contact of said charge roller with said body to be charged, said films deform along an outer periphery of said elastic member by a maximum amount, as measured in a radial direction of said charge roller, which is smaller than a thickness of said films.

32. In an electrophotographic image forming apparatus including an image carrier unit comprising a charge roller, which comprises a metallic core and an elastic member covering said core, for charging a surface of a drum-like image carrier in response to a voltage applied between said charge roller and said image carrier to thereby allow a latent image to be optically formed on said surface, films are respectively wrapped around portions of said image carrier corresponding to opposite end portions of said charge roller such that said opposite end portions of said charge roller respectively contact said films, and portions of said elastic member deformed due to compression ascribable to contact of said charge roller with said image carrier have a maximum deformation, as measured in a radial direction of said charge roller, which is smaller than a thickness of said films.

33. A charging roller facing a surface of a body to be charged and applied with a voltage, said charging roller comprising:

a metallic core;

an elastic member covering said core; and films respectively rapped around opposite end portions of said charge roller;

wherein when said elastic member deforms due to compression ascribable to contact of said films with said body to be charged, said films deform along an outer periphery of said elastic member by a maximum amount, as measured in a radial direction of said charge roller, which is smaller than a thickness of said films.

34. A charging roller as claimed in claim 33, wherein opposite end portions of said core are larger in diameter than the other portion of said core, wherein said elastic member is provided on said core, including said opposite end portions, such that said elastic member has a same outside diameter throughout an entire length in an axial direction, and wherein said films are respectively wrapped around portions of said elastic member corresponding to said opposite end portions of said core.

35. A charging roller as claimed in claim 34, wherein said charging roller comprises a charge roller for uniformly charging the body to be charged.

36. A charging roller as claimed in claim 33, wherein said films have a thickness of 100 $\mu$m or below each.

37. A charging roller as claimed in claim 36, wherein said charging roller comprises a charge roller for uniformly charging the body to be charged.

38. A charging roller as claimed in claim 36, wherein said elastic member has a hardness of 65° or above at a room temperature.

39. A charging roller as claimed in claim 38, wherein said charging roller comprises a charge roller for uniformly charging the body to be charged.

40. A charging roller as claimed in claim 36, wherein said elastic member has a thickness of 2.0 mm or below at a room temperature.

41. A charging roller as claimed in claim 40, wherein said charging roller comprises a charge roller for uniformly charging the body to be charged.

42. A charging roller as claimed in claim 40, wherein said elastic member has a hardness of 65° or above at a room temperature.

43. A charging roller as claimed in claim 42, wherein said charging roller comprises a charge roller for uniformly charging the body to be charged.

44. A charging roller as claimed in claim 33, wherein said elastic member has a thickness of 2.0 mm or below at a room temperature.

45. A charging roller as claimed in claim 44, wherein said charging roller comprises a charge roller for uniformly charging the body to be charged.

46. A charging roller as claimed in claim 44, wherein said elastic member has a hardness of 65° or above at a room temperature.

47. A charging roller as claimed in claim 46, wherein said charging roller comprises a charge roller for uniformly charging the body to be charged.

48. A charging roller as claimed in claim 33, wherein said elastic member has a hardness of 65° or above at a room temperature.

49. A charging roller as claimed in claim 48, wherein said charging roller comprises a charge roller for uniformly charging the body to be charged.

50. A charging roller as claimed in claim 33, wherein said charging roller comprises a charge roller for uniformly charging the body to be charged.

51. A charging roller facing a surface of a body to be charged and applied with a voltage, said charging roller comprising:

a metallic core including axially opposite end portions larger in diameter than the other portion;

an elastic member covering said core;

the elastic member provided on said core, including said opposite end portions, such that said elastic member has a same outside diameter throughout an entire length in an axial direction; and films respectively wrapped around portions of said elastic member corresponding to said opposite end portions of said core.

52. A charging roller as claimed in claim 51, wherein said charging roller comprises a charge roller for uniformly charging said body to be charged.

* * * * *